US007703425B2

(12) United States Patent
Schafer et al.

(10) Patent No.: US 7,703,425 B2
(45) Date of Patent: Apr. 27, 2010

(54) ELECTROMOTIVE CAMSHAFT ADJUSTER

(75) Inventors: Jens Schafer, Herzogenaurach (DE); Mike Kohrs, Wilthen (DE); Jonathan Heywood, Pettstadt (DE)

(73) Assignee: Schaeffler KG, Herzogenaurach (DE)

( * ) Notice: Subject to any disclaimer, the term of this patent is extended or adjusted under 35 U.S.C. 154(b) by 544 days.

(21) Appl. No.: 11/573,496

(22) PCT Filed: Jul. 13, 2005

(86) PCT No.: PCT/EP2005/007583

§ 371 (c)(1),
(2), (4) Date: Feb. 9, 2007

(87) PCT Pub. No.: WO2006/018080

PCT Pub. Date: Feb. 23, 2006

(65) Prior Publication Data

US 2009/0199797 A1 Aug. 13, 2009

(30) Foreign Application Priority Data

Aug. 10, 2004 (DE) ..... 10 2004 038 681

(51) Int. Cl.
*F01L 1/34* (2006.01)

(52) U.S. Cl. ..... 123/90.17; 464/160

(58) Field of Classification Search ..... 123/90.15, 123/90.16, 90.17, 90.18; 464/1, 2, 160; 475/5, 475/331

See application file for complete search history.

(56) References Cited

U.S. PATENT DOCUMENTS

| | | | | |
|---|---|---|---|---|
| 4,747,375 | A | 5/1988 | Williams | |
| 6,138,622 | A | 10/2000 | Heer | |
| 6,457,446 | B1 * | 10/2002 | Willmot | 123/90.17 |
| 6,517,772 | B1 | 2/2003 | Woolf | |
| 6,981,478 | B2 * | 1/2006 | Schafer et al. | 123/90.17 |
| 7,308,876 | B2 * | 12/2007 | Schafer et al. | 123/90.17 |
| 2001/0020460 | A1 | 9/2001 | Heer | |
| 2002/0017257 | A1 | 2/2002 | Axmacher et al. | |

FOREIGN PATENT DOCUMENTS

| | | |
|---|---|---|
| DE | 4110195 | 2/2000 |
| DE | 10207760 | 9/2003 |
| JP | 10305344 | 11/1998 |
| JP | 2000129312 | 5/2000 |
| WO | 0231374 | 4/2002 |
| WO | WO 2004035997 A1 * | 4/2004 |
| WO | WO 2004035998 A1 * | 4/2004 |

* cited by examiner

*Primary Examiner*—Ching Chang
(74) *Attorney, Agent, or Firm*—Volpe and Koenig, P.C.

(57) ABSTRACT

An electromotive camshaft adjuster for adjusting the angle of rotation of the camshaft (14) of an internal combustion engine relative to the crankshaft thereof is provided. The camshaft adjuster includes a triple-shaft gear mechanism, which has a driving wheel (2, 2*a*') that is fixed to the crankshaft and is embodied as a sprocket or a synchronous belt wheel, an output part which is fixed to the camshaft, and an adjustment shaft (18, 18') which is connected in a rotationally fixed manner to a rotor of an electric adjustment motor, having a stator that is fixed on the internal combustion engine. In order to keep the effort for producing the adjusting gears relatively low, the triple-shaft gear mechanism is preferably constructed as a swashplate or single eccentric internal gear drive (1, 25), the effort for production thereof being minimized by forming the same in a non-cutting manner, reducing the number of components, and inexpensively adjusting or compensating the backlash.

16 Claims, 8 Drawing Sheets

ELECTROMOTIVE CAMSHAFT ADJUSTER

BACKGROUND

The invention relates to an electromotive camshaft adjuster for adjusting the angle of rotation of the camshaft of an internal combustion engine relative to the crankshaft thereof.

Electromotive camshaft adjusters are distinguished by quick and exact camshaft adjustment for the entire operating range of the internal combustion engine. This also applies for a cold start and a restart of the internal combustion engine after stalling.

Electrical camshaft adjusters are comprised of an adjustment mechanism connected in a rotationally fixed manner to the camshaft and an electromotive adjusting drive, which is fixed to the adjusting shaft and whose motor shaft attaches to the adjusting shaft of the adjusting mechanism rotating at the camshaft rotational speed.

For the most part, the following triple-shaft gear mechanisms are used as the adjustment mechanism:

Swashplate (or Wobbleplate) Drive.

These drives have a simple construction. Their ability to be manufactured in mass production, however, has not been clarified. In addition, they are susceptible to tolerances, and the manufacture of the teeth parts is associated with high costs, because these parts have to be manufactured with cutting methods due to high loading and for reasons of accuracy.

Double Eccentric Internal Gear Drive.

This type of drive is very functional and quiet running, but generates considerable costs due to the number of components.

Planetary and Cycloid Gears (So-Called Harmonic Drive Gears).

The latter is described in DE 40 227 35 A1, in which an electromotive camshaft adjuster for adjusting the angle of rotation of an internal combustion engine relative to the crankshaft thereof is disclosed, with a triple-shaft transmission, which has a crankshaft-fixed drive wheel constructed as a sprocket or synchronous belt wheel and a camshaft-fixed driven part and also an adjusting shaft, which is connected in a rotationally fixed manner to the rotor of an electric adjustment motor and whose stator is fixed to the internal combustion engine.

This cycloid gear drive is distinguished by low installation space and high function reliability, but requires a large construction expense.

The invention is based on the objective of constructing a triple-shaft gear mechanism for an electromotively driven camshaft adjuster, which provides a relatively low manufacturing expense.

SUMMARY

The objective is met by a device according to the invention.

The swashplate drive and the single eccentric internal gears offer various possibilities for reducing manufacturing costs. Both types of drives can be produced largely without cutting. The swashplate drive also offers the possibility of simple tooth backlash compensation, while the single eccentric internal gears offers many possibilities for reducing the number of components.

It is advantageous that brushless DC motors are provided as electric adjustment motors, especially motors with rare-earth magnets and with bipolar operation. These motors are distinguished through simple construction, high acceleration, and practically wear-free operation due to the lack of a commutator.

The first and second conical gear wheel and also the swashplate of the swashplate drive with teeth on both sides is suitable preferably for powder metallurgical production. The strength and hardness of these components can be increased after sintering, for example, through temper rolling of the teeth or hot pressing or high-pressure pressing without negatively affecting the accuracy of the parts. The components listed above can also be made from a steel blank through wobble pressing or axial rolling.

An important feature for the quality of the adjustment drive is the correct circumferential backlash of the teeth pairs. Through the dynamic camshaft torque, backlash that is too large can lead to rotational vibrations between the two conical gear wheels during operation. Therefore, noise or control problems can be produced. If the backlash is too small, the adjustment gear will jam or its efficiency will be too poor. However, backlash cannot be avoided. The magnitude of backlash is influenced by the quality of the teeth in the swashplate and the conical gear wheels and also by the dimensional tolerances of the gear wheel pairs that determine the axial distance and the alignment.

Limiting the dimensional tolerances to their permissible highest value through high manufacturing accuracy is successful only to a limited extent. For this reason, it is important to make the backlash adjustable. The backlash compensation ensures that the minimum circumferential backlash is produced when reaching the top tolerance limits of the dimensional tolerances of the components. If the dimensions of the components reach the lower tolerance limits or between the lower and upper tolerance limits, theoretically a profile cutting of the teeth is performed. The backlash is then corrected by a plain washer coupled between the first conical gear wheel and the housing.

Alternatively, the teeth can be biased by springs between the sprocket wheel drive and the camshaft driven part and/or the adjustment drive, in order to prevent backlash-dependent noise generation. The difficulty of this method lies in maintaining an optimum biasing, which combines low noise generation with high gear efficiency.

An eccentric internal gear drive, which is constructed as a single eccentric internal gear, offers cost advantages in that it has only one internal eccentric for first and second spur gears, which are connected to each other in a rotationally fixed manner and which roll on first and second ring gears. Here, the first spur gear and ring gear are used exclusively for conversion in the phase adjustment and the second spur gear and ring gear are used also or even exclusively as coupling teeth for passing the drive and adjustment power to the camshaft.

The second spur gear here completes the same eccentric motion as the first, because both are connected to each other in a rotationally fixed manner. If the second ring gear/spur gear pair has the same difference in tooth number as the first, it is used only as tooth coupling that does not contribute to the overall modulation of the adjustment gear. However, it is also possible to distribute the overall modulation onto both gear wheel pairs, which gives greater freedom in selecting the teeth.

In principle, like in double eccentric internal gear mechanisms, a claw, segment, or pin coupling, which takes over the coupling function, is also conceivable instead of the tooth coupling. The single eccentric internal gear mechanism then has an even simpler shape, but the pins or claws must slide on their counter surface for compensating for the eccentric motion. Therefore, a lower efficiency than with a tooth coupling is necessary, in which the second spur gear rolls in the second ring gear with low friction.

For further reducing the friction, the single internal eccentric and the two spur gears and optionally the drive wheel are roller supported, wherein the latter preferably has a four-point support. The roller bearing can be a ball bearing, cylinder bearing, or needle bearing. A four-point bearing is suitable especially for absorbing tilting moments, like those that can appear in a drive wheel. If the bearing friction has a small role relative to construction costs and installation space, then all of the roller bearings can be replaced by sliding bearings for a correspondingly dimensioned drive of the adjustment shaft.

Lower production costs are also achieved by constructing the ring gears and spur gears as annular gears with internal and external teeth, respectively, which are cut into the necessary length by tubes with internal and external profiling, respectively. The profiled tubes can be drawn or extruded or sintered, for example.

Another way to reduce costs is to form the hollow and spur gears made from bands profiled with teeth into annular gears, which are closed by welding or clips and then recalibrated.

Production costs can also be reduced by expanding the first spur gear by the width of the second spur gear and by meshing the first spur gear with two ring gears with equal teeth.

Backlash compensation is performed separately for the two spur gear/ring gear pairs in the single eccentric internal gear, with the backlash compensation being performed in the first spur gear/ring gear pair by selecting a matching eccentric and in the second spur gear/ring gear pair by a correspondingly profile-shifted second spur gear/ring gear or by an additional compensating eccentric that can be adjusted independent of the first eccentric and that is locked in rotation on the adjustment shaft. An especially economical form of the backlash compensation is provided in performing this compensation through slightly conically shaped spur gears and ring gears pushed axially one inside the other up to shortly before linear contact, preferably using its manufacturing-specific conical form.

A more economical way for achieving optimum backlash is provided by a run-in operation of the adjustment gear with a wear layer made from, for example, copper or plastic, which runs in under biasing until reaching a given backlash, which is relatively soft and allows sliding, and which is applied to its teeth.

Instead of through backlash compensation, the tooth noise can also be reduced through helical spur gears and ring gears. Through an opposite pitch of the teeth of the two spur gears and ring gears, their axial forces are canceled out, whereby the bearing is simplified.

Similarly for a swashplate drive, for a single eccentric internal gear, a spring biasing of the teeth between the camshaft driven part and the driving wheel and/or the adjustment drive is also possible for reducing the tooth noise.

A construction of the invention that is favorable to production is provided in that the second ring gear can be constructed in one piece with the driven flange and optionally with the intermediate piece and can be produced through, for example, wobble or axial pressing, sintering, or deep drawing. In this way, the number of components can be considerably reduced.

There are advantages in terms of production if the eccentric and the adjustment shaft can be constructed in one or two pieces with the tooth coupling. The one-piece construction offers the advantage of a smaller number of components. It can be realized by sintering, wobble pressing, and deep drawing. The two-part construction offers the advantage that the eccentric can be produced economically from an eccentric tube, in which a tooth coupling plate can be pressed.

A simple construction, low friction, and freedom of play are achieved in that the single eccentric internal gear has a so-called ball orbital coupling instead of a ring gear/spur gear pair transmitting the camshaft torque, in which balls are guided on each half in circuit tracks of two equal steel plates biased axially and balance the eccentric motion. One steel plate is connected in a rotationally fixed manner to a spur gear and the other steel plate is connected to a camshaft-fixed part.

A single eccentric internal drive with small axial length is achieved in that a driving wheel and a driven part, a first and a second ring gear, and also a first and a second spur gear are arranged coaxial, wherein the driving wheel is connected in a rotationally fixed manner to the first ring gear, the first spur gear is connected in a rotationally fixed manner through a flange to the second ring gear, and also the second spur gear is connected in a rotationally fixed manner to the driven part and the first ring gear meshes with the first spur gear and the second ring gear meshes with the second spur gear.

For certain applications, it can be advantageous that in a single eccentric internal gear, the second ring gear is constructed as a second spur gear and the second spur gear is constructed as a second ring gear, wherein the second ring gear and the second spur gear mutually engage each other.

It is also conceivable that the spur gears and ring gears of the single eccentric internal gear are replaced by corresponding friction wheels. These are distinguished through low noise and resistance to wear, but require sufficient contact force.

BRIEF DESCRIPTION OF THE DRAWINGS

Additional features of the invention will be understood from the following description and the drawings, in which an embodiment of the invention is shown schematically. Shown are.

DETAILED DESCRIPTION OF THE PREFERRED EMBODIMENTS

Figure 1:
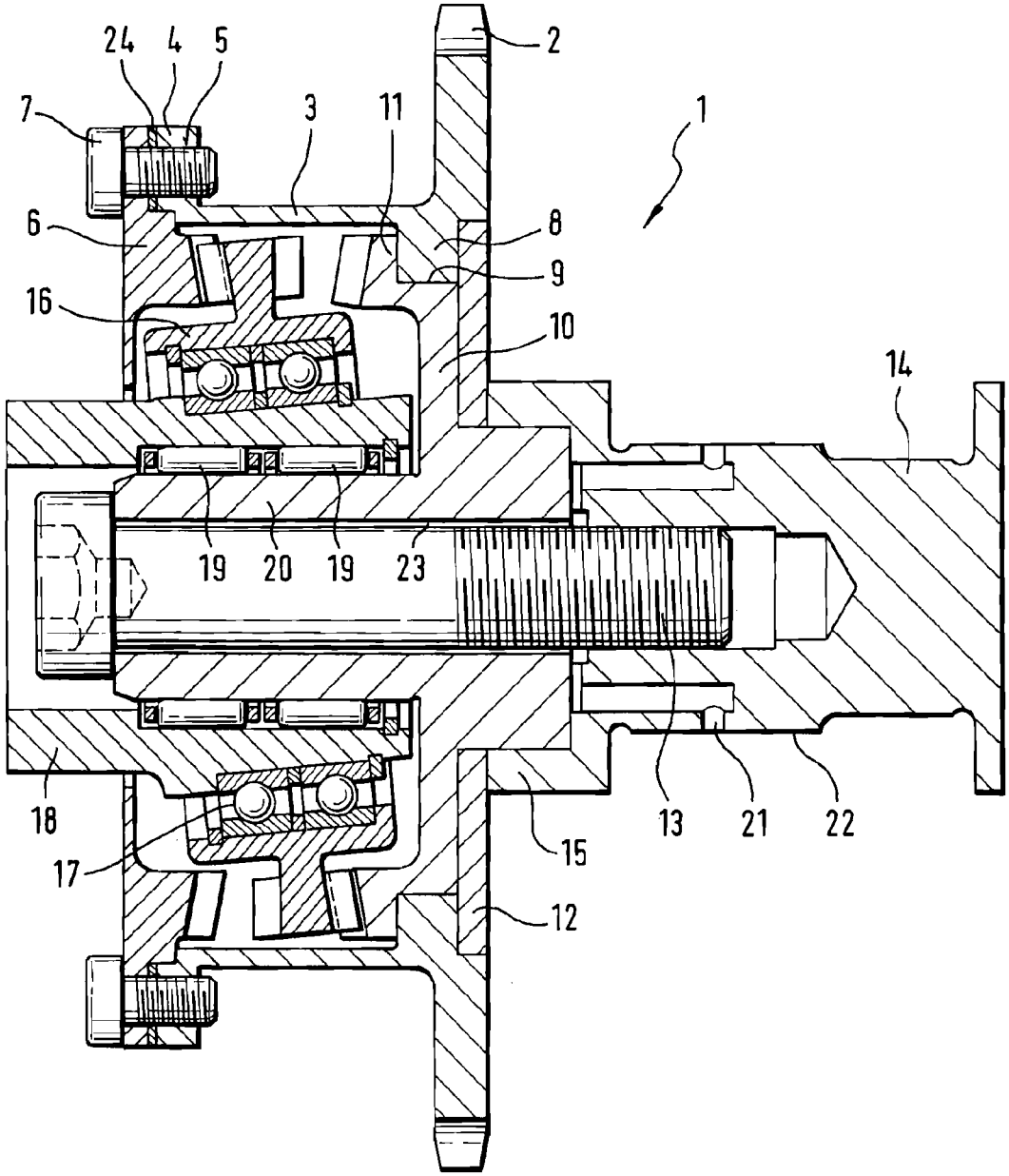
FIG. 1 a longitudinal section view through a swashplate drive.

In FIG. 1 a longitudinal section through a swashplate drive 1 is shown. This has a driving wheel 2 constructed as a sprocket pinion. This driving wheel is connected in a rotationally fixed manner to a crankshaft of an internal combustion engine via a sprocket (not shown) and is constructed in one piece with a rotationally symmetric gear housing 3.

The gear housing 3 has on its free end an outer flange 4 with threaded bores 5, on which a first conical gear wheel 6 is connected by means of screws 7. On the driving wheel-side end of the gear housing 3 there is an inner flange 8, which is used for radial and axial support or position fixing of the gear housing 3 and the driving wheel 2. The radial support of the housing takes place on a step 9 of a second conical gear wheel 10, while its axial position fixing is realized by a shoulder 11 of the housing in connection with a stopping plate 12, which is pressed and/or welded to the driving wheel 2.

The second conical gear wheel 10 is connected in a rotationally fixed manner to a camshaft 14 by a central tension screw 13. A hollow flange 15 on the free end of the camshaft 14 is used for the axial and radial position fixing of the second conical gear wheel 10 and the stopping plate 12.

Between the conical gear wheels 6, 10 there is an inclined swashplate 16 with teeth on both sides. The inclination of the swashplate 16 is selected so that the teeth of each side are continuously engaged with one of the two conical gear wheels 6, 10. The swashplate 16 is supported by two deep groove ball bearings 17 constructed as fixed bearings on an adjustment shaft 18, which is supported, in turn, on a cylindrical part 20 of the second conical gear wheel 10 with two needle bearings 19 constructed as movable bearings.

The adjustment shaft 18 is connected in a rotationally fixed manner to a not-shown rotor of a brushless, reversible DC motor.

The two conical gear wheels 6, 10 and the swashplate 16 are fabricated using powder metallurgy. Their teeth are post-treated for increasing the strength for constant spacing accuracy through, for example, temper rolling of the teeth or hot or high-pressure pressing.

The swashplate gear 1 is fed via oil lines 21, which start from a camshaft bearing 22 and lead up to an annular space 23 and further through a not-shown, radial bore to the bearings 19 and 17 and also to the teeth. A corresponding shape of the first conical gear wheel 6 guarantees a sufficient oil level in the swashplate gear 1.

The backlash can be adjusted easily in the swashplate gear 1. Through a fitting shim 24, which can be placed between the outer flange 4 of the gear housing 3 and the first conical gear wheel 6, the backlash is set to zero. By replacing this shim by one of increased thickness, the backlash is adjusted.

The swashplate drive 1 functions in the following way:

In regular operation, that is, at constant phase position, the swashplate drive 1 including the rotor of the not-shown electric adjustment motor turns as a whole at the camshaft rotational speed. For adjusting the control times for a retarded or advanced position, the adjustment motor accelerates or decelerates its rotor relative to the camshaft 14. In this way, the adjustment shaft 18 turns in front of or behind relative to the gear housing 3, whereby the swashplate 16 rolls on the conical gear wheels 6, 10 according to the low difference in tooth number between the swashplate and the conical gear wheels with large modulation and completes the phase adjustment.

Figure 2:
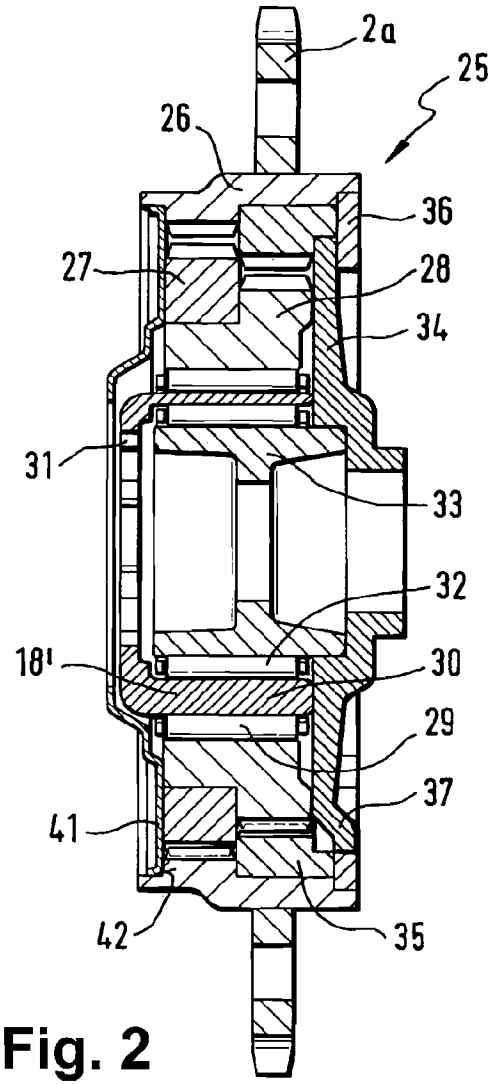
FIG. 2 a longitudinal section view through a single eccentric internal gear drive.
Figure 3:
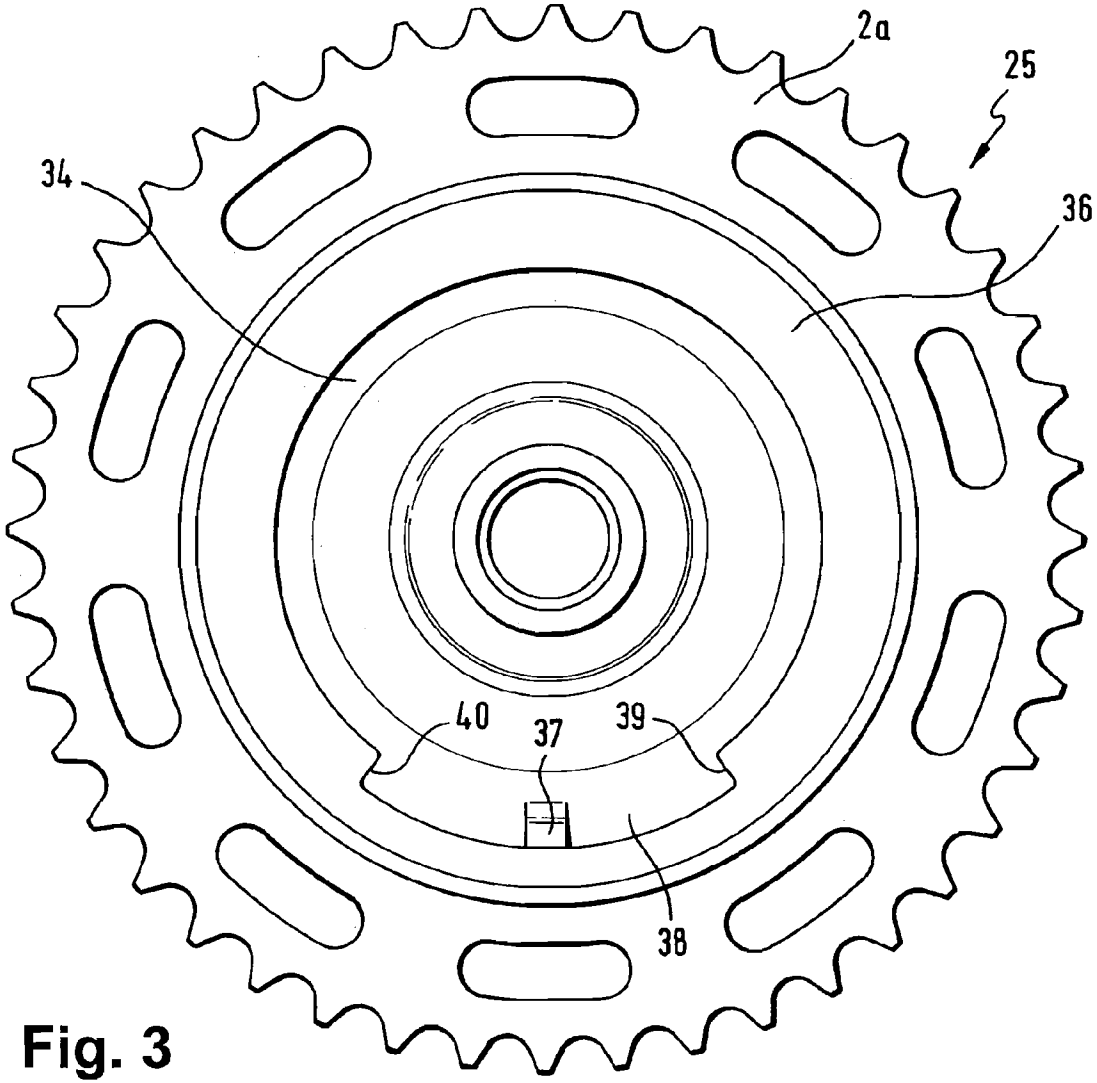
FIG. 3 a view of the single eccentric internal gear drive from FIG. 2.

FIG. 2 shows a longitudinal section through a single eccentric internal gear drive 25 and FIG. 3 shows a view of the driven side of this gear drive.

In the longitudinal section of FIG. 2, a driving wheel 2*a* constructed as a sprocket wheel is to be seen, which is connected in a rotationally fixed manner to a first ring gear 26. This connection can be achieved through pressing, especially after knurling and/or through laser welding.

The first ring gear 26 meshes with a first spur gear 27, which is connected in a rotationally fixed manner to a second spur gear 28 through an interference fit. This is supported by a first needle bearing 29 on a single internal eccentric 30, which is in rotationally fixed connection with a not-shown rotor of an electric adjustment motor via a tooth coupling 31. The internal eccentric 30 is supported by a second needle bearing 32 on an intermediate piece 33, which can be tensioned in a rotationally fixed manner by a not-shown central tension screw to the similarly not-shown camshaft via a driven flange 34. The second spur gear 28 meshes with a second ring gear 35, on whose periphery the first ring gear 26 is supported with the driving wheel 2*a* in a sliding manner.

The second ring gear 35 is connected in a rotationally fixed manner to the camshaft-fixed driven flange 34. Both contact a stop plate 36 axially, which is connected in a rotationally fixed manner to the first ring gear 26.

The driven flange 34 has a tab 37, which can pivot in an annular section 38 of the stop plate 36 defining the adjustment region of the single eccentric internal gear drive 25 between two stops 39, 40, as also emerges from FIG. 3. The driven flange 34 can be produced without cutting through sintering, wobble pressing, or axial rolling. It can also be sintered together with the second ring gear 35.

A sheet-metal cover 41, which is pressed into a recess 42 and which limits the axial movement of the two spur gears 27, 28 and an adjustment shaft 18', is provided on the adjustment motor side of the single eccentric internal gear drive 25.

The single eccentric internal gear drive 25 functions as follows:

In regular operation, the single eccentric internal gear drive 25 and the rotor of the adjustment motor rotate as a whole at the camshaft rotational speed. When the camshaft is adjusted to a retarded or advanced position, the adjustment motor accelerates or decelerates the adjustment shaft 18' with the internal eccentric 30. In this way, the spur gears 27, 28 roll on the ring gears 26, 35 and produce the phase adjustment with large modulation due to the low difference in tooth number of the associated spur gears/ring gears.

Figure 4:
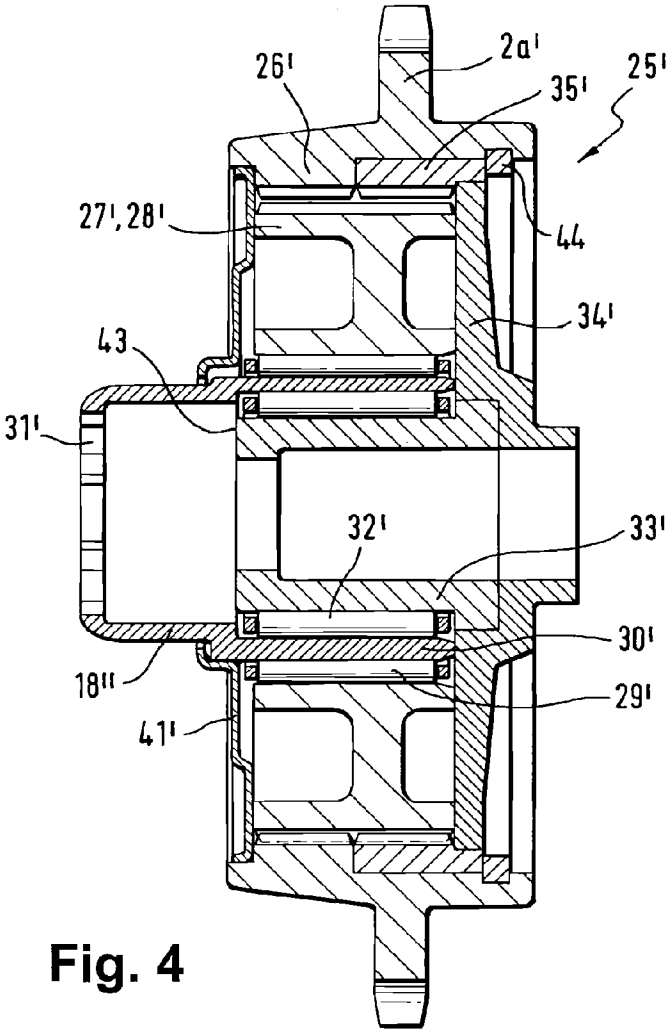

FIG. 4 represents a single eccentric internal gear drive 25' as a structural variant of the single eccentric internal gear 25 of FIG. 2. One driving wheel 2*a'* is sintered together with a first ring gear 26' and its teeth in one piece. If necessary, the teeth can be temper rolled, in order to achieve increased tooth strength.

A second ring gear 35' is connected to a driven flange 34' by an interference fit and by welding. Both components can be produced advantageously also in one piece through sintering.

A first spur gear 27' is expanded by the width of a second spur gear 28'. The teeth of the ring gears 26', 35' have a constant internal diameter thanks to the profile shift despite different tooth numbers and thus makes it possible to mesh with the first spur gear 27'. The first spur gear 27' can be produced through sintering but also through wobble pressing, cold pressing, or extrusion.

The first spur gear 27' is supported by means of a first needle bearing 29' on a single internal eccentric 30' and this is supported by means of a second needle bearing 32' on an intermediate piece 33'. This can be produced through, among other things, sintering, extrusion, or deep drawing. Its reduced outer and inner diameter relative to the intermediate piece 33 makes contact of the screw head of the central tensioning screw necessary on an end surface 43 of the intermediate piece 33'. This results in the modified form of an adjustment shaft 18". This same can be produced through extrusion or deep drawing and a teeth coupling 31' through stamping.

The sheet-metal cover 41' is also used in this variant as an axial stop for the first spur gear 27' and the adjustment shaft 18" and also as a lubricating oil guide. A snap ring 44 is used as an axial stop for the second ring gear 35' on the driven side.

Figure 5:
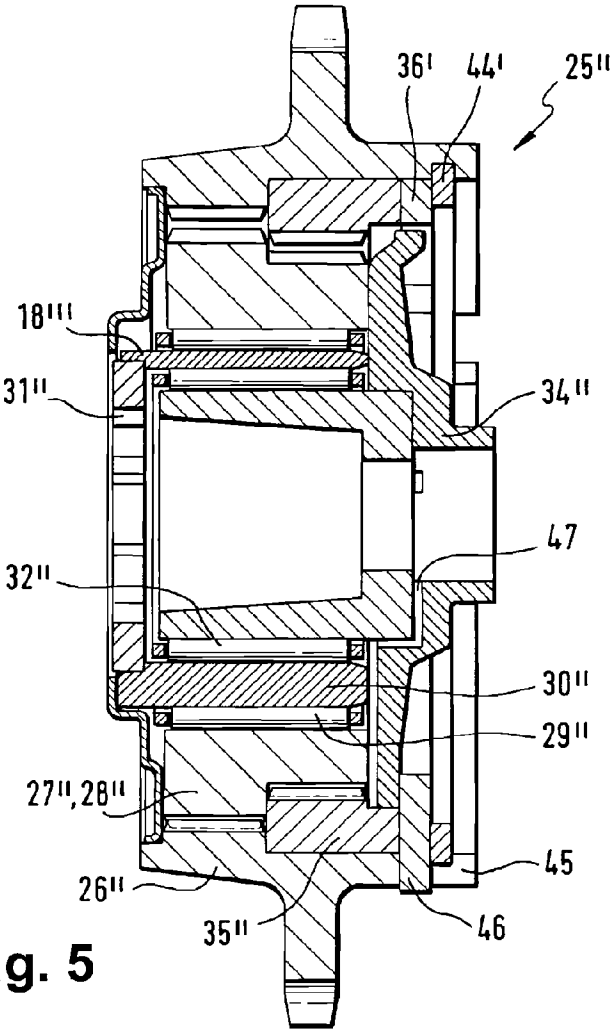
FIGS. 4 to 7 longitudinal section views through structural variants of the single eccentric internal gear drive of FIG. 2.

The single eccentric internal gear drive 25" shown in FIG. 5 differs from the single eccentric internal gear drives 25 or 25' by the attachment of a stop plate 36' on the first ring gear 26". This is performed tangentially by pegs 46 of the stop plate 36' projecting into slots 45 of this wheel, while a snap ring 44' is used as an axial retainer.

Another difference lies in a two-part single internal eccentric 30", which can be cut from a correspondingly shaped, extruded tube and which can be pressed and welded with a stamped tooth coupling 31".

In a sintered driven flange 34", a radial lubricating oil channel 47 is engraved, which provides the needle bearing 32", 29" and the teeth of the spur gears and ring gears 27", 28", 26", 35" with lubricating oil. The two spur gears 27", 28" are sintered in one piece, including their teeth.

Figure 6:
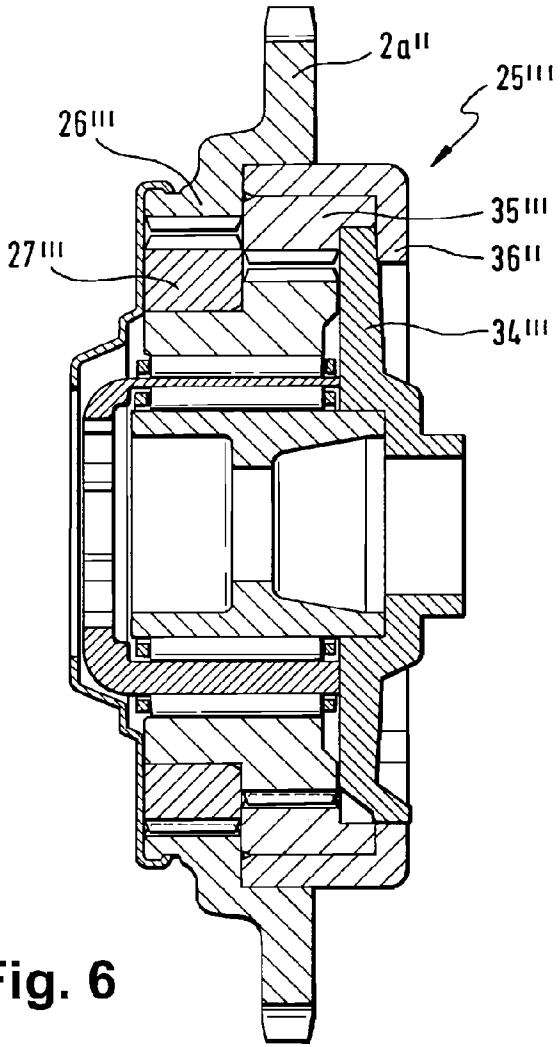

The single eccentric internal gear drive 25''' according to FIG. 6 is distinguished from the preceding variants through the following features:

A one-piece driving wheel **2*a*"/first ring gear 26'''** is suitable as a wobble pressed part due to its dimensions;

A deep-drawn stop plate 36" is connected in a rotationally fixed manner to the driving wheel **2*a*" by an interference seat and laser welding. It is used with its inner periphery as a sliding bearing for the driving wheel 2*a*" and for the first ring gear 26''' and also as an axial stop for a second ring gear 35''' and the driven flange 34'''** connected to it.

Figure 7:
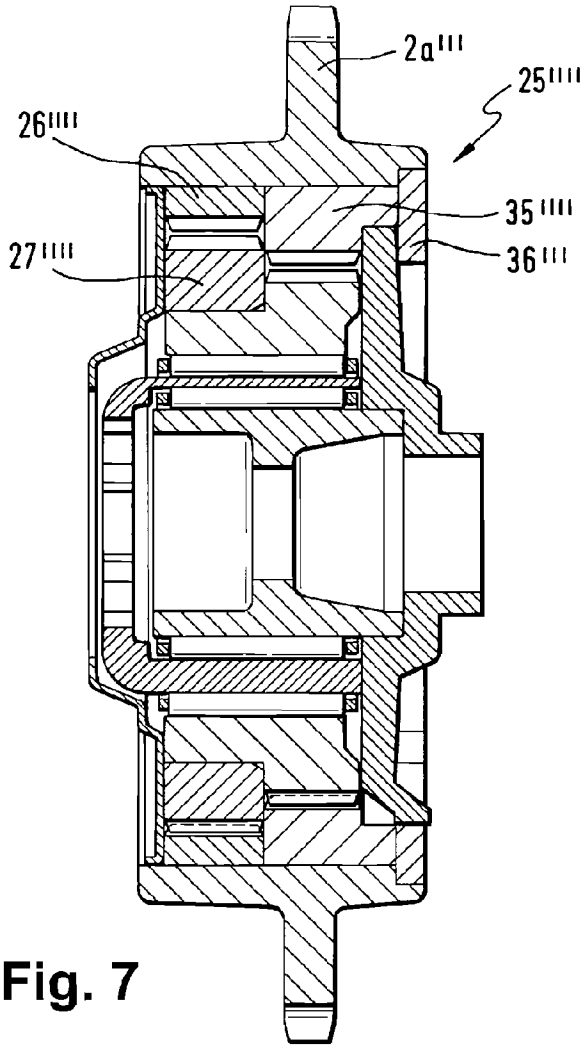

The single eccentric internal gear drive 25'''' shown in FIG. 7 is distinguished by a first spur gear and ring gear 27'''', 26'''' with a rectangular cross section. These rings are suitable especially for extending a corresponding internal or external geared tube. The same applies for the first spur gear 27 of FIG. 2 and the first spur gear 27''' of FIG. 6.

The first ring gear 26''' is pressed into the driving wheel **2*a*''', while a second ring gear 35''' is supported in the driving wheel 2*a*''' in a sliding way and guided axially by a stop plate 36'''** welded to the same.

Figure 8:
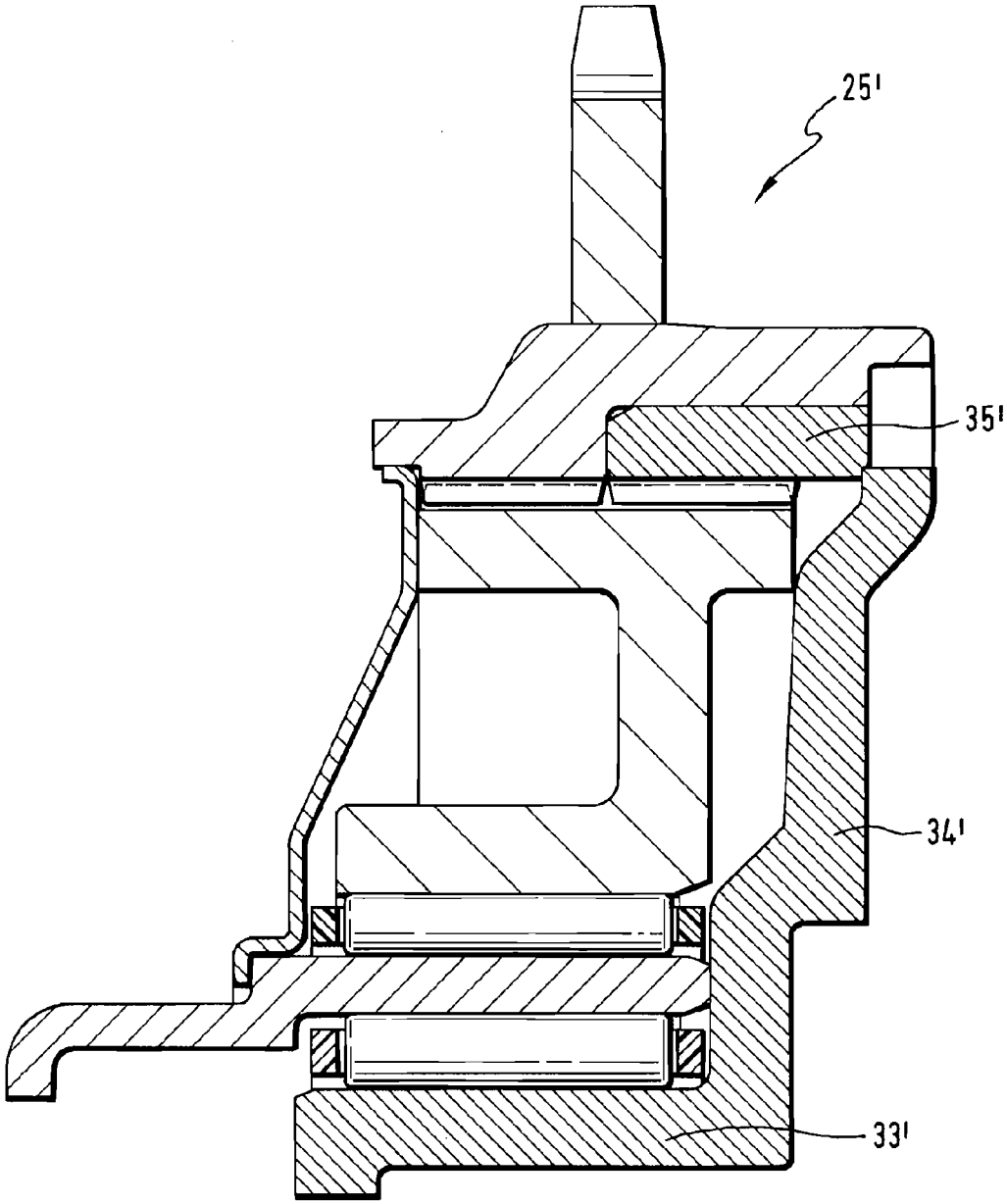
FIG. 8 a cross sectional view through the single eccentric internal gear from FIG. 4, but with a one-piece construction of the second ring gear, the drive flange, and the intermediate piece.

In FIG. 8, the single eccentric internal gear drive 25' from FIG. 4 is shown in cross section, but with a one-piece construction of the intermediate piece 33' with the driving flange 34' and the ring gear 35'. Therefore, the number of components is reduced significantly. Sintering is the main process considered for production.

Figure 9:
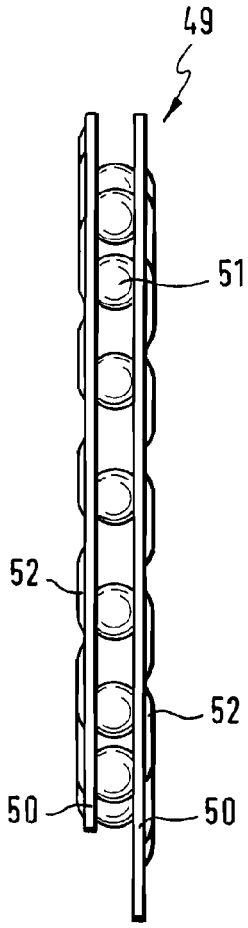
FIG. 9 a side view of a ball orbital coupling.
Figure 10:
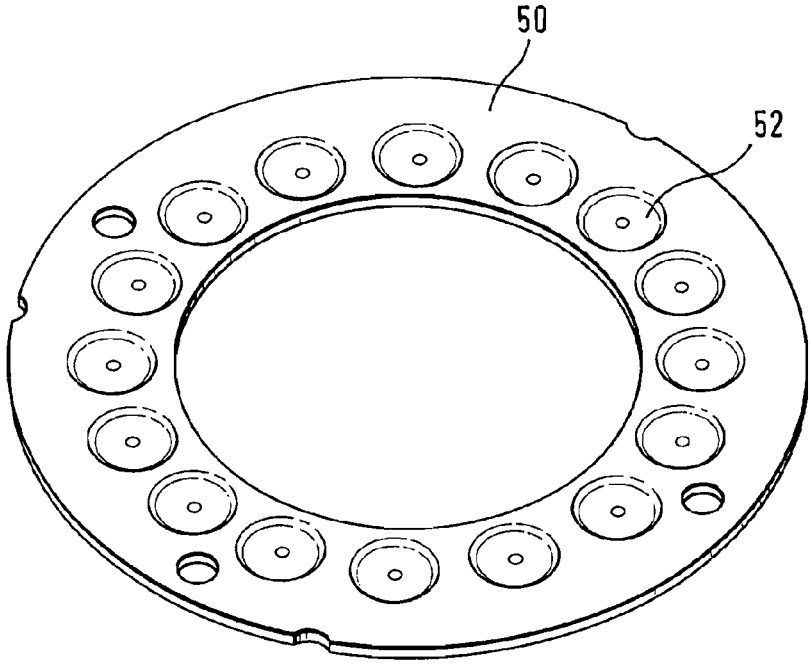
FIG. 10 a perspective view of a plate of the ball orbital coupling from FIG. 9.

FIG. 9 shows a side view of a so-called ball orbital coupling 49, which is used as a replacement for a ring gear/spur gear tooth coupling for compensating the eccentric motion similar to a claw, segment, or pin coupling. The ball orbital coupling 49 has two steel plates 50, between which balls 51 are jammed under axial biasing. The balls 51 are guided on each half in circuit tracks 52 of the steel plates 50 (see also FIG. 10), where they execute a circular motion, without requiring play. One of the steel plates 50 is connected in a rotationally fixed manner to one of the spur gears of the single eccentric internal gear drive and the other is connected to a camshaft-fixed part of the gear.

Figure 11:
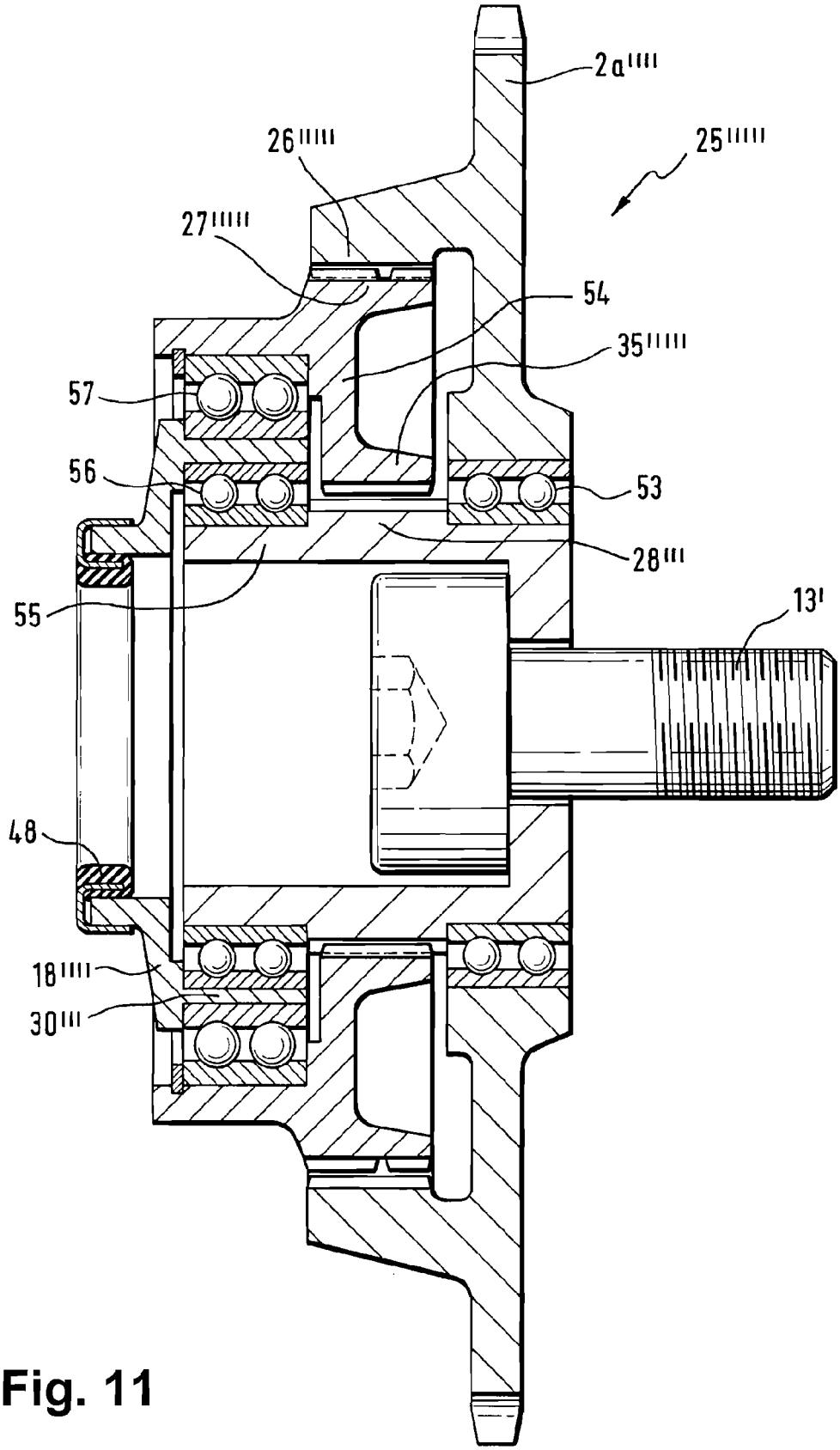
FIG. 11 a cross sectional view through a single eccentric internal gear drive with coaxial arrangement of gear wheels.

FIG. 11 represents a single eccentric internal gear drive 25''''', which is connected in a rotationally fixed manner to a camshaft (not shown) via an elastomer coupling 48. The special characteristic of this gear is the coaxial arrangement of a first and second ring gear 26''''', 35''''' and a first and second spur gear 27''''', 28'''. In this way, relatively little axial space is required. In addition, the spacing of the first ring gear 26''''' to a double deep groove ball bearing 53, which receives the tilting moment of this wheel and the load of a driving wheel **2*a*'''', is relatively small. This has a positive effect on the rolling behavior of the teeth due to the smaller radial shifting. The driving wheel 2*a*'''' is constructed in one piece with the first ring gear 26'''''. The first spur gear 27''''' and the second ring gear 35''''', which are connected to each other by a flange 54, are constructed in the same way. The second spur gear 28''' is constructed in one piece with a driven part 55 and an adjustment shaft 18'''' with a single internal eccentric 30'''. The single internal eccentric 30''' and the first spur gear 27''''' with the second ring gear 35''''' are supported on a second and third double deep groove ball bearing 56, 57**.

Figure 12:
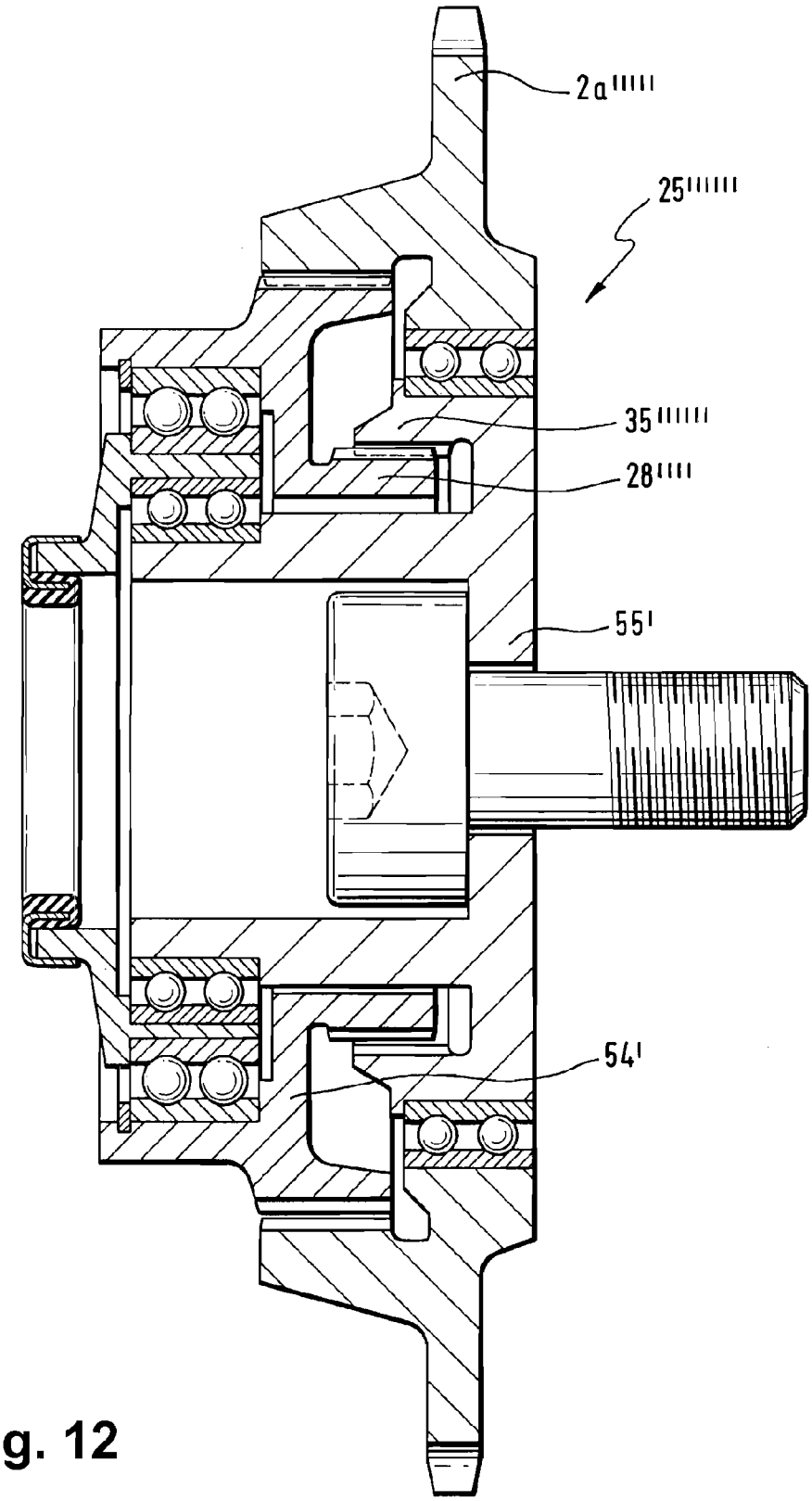
FIG. 12 a cross sectional view through a single eccentric internal gear drive according to FIG. 11, but with interchanged second ring gear and spur gear.

In FIG. 12, the cross section of a single eccentric internal gear drive 25''''' is shown, which differs from that of FIG. 11 through the interchanging of the second ring gear and the second spur gear. These are constructed in FIG. 12 as a new second ring gear 35''''' and a new second spur gear 28'''' and mutually engage each other. A driving wheel **2*a*''''', a flange 54', and a driven part 55" are adapted to the modified construction. The function of the single eccentric internal gear drive 25''''' and 25''''' corresponds to the gear drive shown in FIGS. 2 to 8**.

List of reference symbols

| | |
|---|---|
| 1 | Swashplate drive |
| 2, 2a, 2a', 2a", 2a''', 2a'''', 2a''''' | Driving wheel |
| 3 | Gear housing |
| 4 | Outer flange |
| 5 | Threaded bore |
| 6 | First conical gear wheel |
| 7 | Screw |
| 8 | Inner flange |
| 9 | Step |
| 10 | Second conical gear wheel |
| 11 | Shoulder |
| 12 | Stop plate |
| 13, 13' | Central tensioning screw |
| 14 | Camshaft |
| 15 | Hollow flange |
| 16 | Swashplate |
| 17 | Deep groove ball bearing |
| 18, 18', 18", 18''', 18'''' | Adjustment shaft |
| 19 | Needle bearing |
| 20 | Cylindrical part |
| 21 | Oil line |
| 22 | Camshaft bearing |
| 23 | Annular space |
| 24 | Shim |
| 25, 25', 25", 25''', 25'''', 25''''', 25'''''' | Single eccentric internal gear drive |
| 26, 26', 26", 26''', 26'''', 26''''' | First ring gear |
| 27, 27', 27", 27''', 27'''', 27''''' | First spur gear |
| 28, 28', 28", 28''', 28'''' | Second spur gear |
| 29, 29', 29" | First needle bearing |
| 30, 30', 30", 30''' | Single internal eccentric |
| 31, 31', 31" | External spline coupling |
| 32, 32', 32" | Second needle bearing |
| 33, 33' | Intermediate piece |
| 34, 34', 34", 34''' | Driven flange |
| 35, 35', 35", 35''', 35'''', 35''''', 35'''''' | Second ring gear |
| 36, 36', 36", 36''' | Stop plate |
| 37 | Tab |
| 38 | Ring section |
| 39 | First stop |
| 40 | Second stop |
| 41, 41' | Sheet-metal cover |
| 42 | Recess |
| 43 | End surface |
| 44, 44' | Snap ring |
| 45 | Slot |
| 46 | Peg |
| 47 | Lubricating oil channel |
| 48 | Elastomer coupling |
| 49 | Ball orbital coupling |
| 50 | Steel plate |
| 51 | Ball |
| 52 | Circuit track |
| 53 | First double deep groove ball bearing |
| 54, 54' | Flange |
| 55, 55' | Driven part |
| 56 | Second double deep groove ball bearing |

-continued

| List of reference symbols | |
|---|---|
| 57 | Third double deep groove ball bearing |
| 58 | Third spur gear |

The invention claimed is:

1. An electromotive camshaft adjuster for adjusting an angle of rotation of a camshaft of an internal combustion engine relative to a crankshaft thereof, comprising a triple-shaft gear mechanism, which has a driving wheel driven by the crankshaft and a camshaft-fixed driven part and also an adjustment shaft, which is connected in a rotationally fixed manner to a rotor of an electric adjustment motor, having a stator that is fixed on the internal combustion engine, the triple-shaft gear mechanism, which is constructed as a swashplate and is comprised of gear wheel sets and housing parts produced in a non-cutting manner and has devices for adjusting or compensating backlash, the swashplate drive has a first, sprocket-fixed conical gear wheel, a second, camshaft-fixed conical gear wheel, and a swashplate with teeth on both sides, that are produced using powder metallurgy and have increased strength and hardness after sintering through temper rolling of teeth thereof or hot or high-pressure pressing.

2. The camshaft adjuster according to claim 1, wherein a brushless DC motor is provided as the electric adjustment motor.

3. The camshaft adjuster according to claim 1, wherein the swashplate drive has a cylindrical gear housing with an outer flange constructed in one piece with the drive wheel, and the first, sprocket-fixed conical gear wheel is screwed onto the outer flange of the gear housing, wherein the backlash between the swashplate and the conical gear wheel can be adjusted by a fitting shim between the outer flange and the first conical gear wheel.

4. The camshaft adjuster according to claim 1, wherein a run-in operation of adjustment gears is provided, with a wear layer, which is applied to teeth thereof, which is relatively soft and can slide, and which is made from copper or plastic, which runs in until reaching a predetermined backlash under biasing.

5. An electromotive camshaft adjuster for adjusting an angle of rotation of a camshaft of an internal combustion engine relative to a crankshaft thereof, comprising a triple-shaft gear mechanism, which has a driving wheel driven by the crankshaft and a camshaft-fixed driven part and also an adjustment shaft, which is connected in a rotationally fixed manner to a rotor of an electric adjustment motor, having a stator that is fixed on the internal combustion engine, the triple-shaft gear mechanism, which is constructed as a single eccentric internal gear drive, and is comprised of gear wheel sets and housing parts produced in a non-cutting manner and has devices for adjusting or compensating backlash, the with a single internal eccentric on which first and second spur gears are attached, which are connected to each other in a rotationally fixed manner and roll on first and second ring gears, the first spur gear and the first ring gear pass through drive and adjustment power to the camshaft as coupling teeth or exclusive of a modulation of a phase position and the second spur gear and the second ring gear.

6. The camshaft adjuster according to claim 5, wherein the single internal eccentric and the two spur gears are roller supported.

7. The camshaft adjuster according to claim 5, wherein the first and second ring gears and the first and second spur gears are constructed as annular gears with internal or external teeth, cut from internal or external teeth-profiled tubes in a necessary length, wherein the tooth-profiled tubes are drawn or extruded or sintered.

8. The camshaft adjuster according to claim 5, wherein the first and second ring gears and the first and second spur gears are shaped from tooth-profiled bands, closed through welding or clipping and recalibrated into annular gears.

9. The camshaft adjuster according to claim 5, wherein backlash compensation is provided in the first ring gear and the first spur gear by installing a matching single internal eccentric, while backlash compensation is provided in the second ring gear and second spur gear either through corresponding profile shifting of teeth thereof or through an additional compensation eccentric that can be adjusted independent of the single internal eccentric and that is locked in rotation on the adjustment shaft.

10. The camshaft adjuster according to claim 5, wherein backlash compensation is provided through slightly conical spur gears and ring gears, which can move one inside another axially up to a linear contact.

11. The camshaft adjuster according to claim 5, wherein teeth of the first and second ring gears and the first and second spur gears are provided with a coating made from ductile material and intermeshing ones of the teeth are mounted under biasing, and the ductile material is copper or a plastic.

12. The camshaft adjuster according to claim 5, wherein the second ring gear is constructed in one piece with a driven flange and is produced through wobble or axial pressing, sintering, or deep drawing.

13. The camshaft adjuster according to claim 5, wherein the single internal eccentric and the adjustment shaft are formed in one part or two parts with an external spline coupling.

14. The camshaft adjuster according to claim 5, wherein the single eccentric internal gear drive has a ball orbital coupling, in which balls, which are guided on each half in circuit tracks of two equal, axially biased steel plates, transmit torque without play and compensate the eccentric motion, instead of a ring gear/spur gear pair transmitting the camshaft torque, wherein one of the steel plates is connected in a rotationally fixed manner to one of the spur gears of the gear drive and the other plate is connected in a rotationally fixed manner to a camshaft-fixed part thereof.

15. An electromotive camshaft adjuster for adjusting an angle of rotation of a camshaft of an internal combustion engine relative to a crankshaft thereof, comprising a triple-shaft gear mechanism, which has a driving wheel driven by the crankshaft and a camshaft-fixed driven part and also an adjustment shaft, which is connected in a rotationally fixed manner to a rotor of an electric adjustment motor, having a stator that is fixed on the internal combustion engine, the triple-shaft gear mechanism, which is constructed as a single eccentric internal gear drive, and is comprised of gear wheel sets and housing parts produced in a non-cutting manner and has devices for adjusting or compensating backlash, and the single eccentric internal gear drive includes a single internal eccentric, on which a third spur gear is attached, which rolls on a first and second ring gear, wherein a number of teeth of the first ring gear deviates from a number of teeth of the second ring gear.

16. The camshaft adjuster according to claim 1, wherein teeth of the conical gear wheels and the swashplate are provided with a coating made from ductile material and intermeshing ones of the teeth are mounted under biasing, and the ductile material is copper or a plastic.

* * * * *